US011311075B2

(12) United States Patent
Dong et al.

(10) Patent No.: US 11,311,075 B2
(45) Date of Patent: Apr. 26, 2022

(54) COMFORTABLE DRESS SHOES

(71) Applicant: Chez Nous Brands, Inc., New York, NY (US)

(72) Inventors: WeiQin Dong, New York, NY (US); Jeffrey Alan Henderson, New York, NY (US); Roxann Vinelle Clarke, New York, NY (US); Sara Jaramillo, Medellin (CO)

(73) Assignee: Chez Nous Brands, Inc., New York, NY (US)

( * ) Notice: Subject to any disclaimer, the term of this patent is extended or adjusted under 35 U.S.C. 154(b) by 205 days.

(21) Appl. No.: 16/218,960

(22) Filed: Dec. 13, 2018

(65) Prior Publication Data

US 2019/0183208 A1 Jun. 20, 2019

Related U.S. Application Data

(60) Provisional application No. 62/599,549, filed on Dec. 15, 2017.

(51) Int. Cl.
*A43B 7/14* (2006.01)
*A43B 13/12* (2006.01)
(Continued)

(52) U.S. Cl.
CPC ..... *A43B 7/1425* (2013.01); *A43B 7/149* (2013.01); *A43B 13/122* (2013.01); *A43B 13/127* (2013.01); *A43B 23/0235* (2013.01)

(58) Field of Classification Search
CPC ..... A43B 7/1425; A43B 7/149; A43B 7/1445; A43B 7/148; A43B 13/386; A43B 23/0235; A43B 23/021; A43B 23/0255; A43B 23/07; A43B 17/006; A43B 17/02; A43B 17/08
See application file for complete search history.

(56) References Cited

U.S. PATENT DOCUMENTS 1,480,234 A * 1/1924 Wedd ..... A43B 7/1425 36/3 B
1,596,146 A * 8/1926 Block ..... A43B 7/1435 602/66
(Continued)

FOREIGN PATENT DOCUMENTS

CN 102132980 A 7/2011
CN 202172924 U 3/2012
(Continued)

OTHER PUBLICATIONS

English Translation of CN 202172924 U, obtained from https://patents.google.com on Jun. 29, 2021, 5 pages.
(Continued)

*Primary Examiner* — Heather Mangine
(74) *Attorney, Agent, or Firm* — Shannon Bates; Harper & Bates LLP

(57) ABSTRACT

A dress shoe includes a flexible upper structure with stretchy lining and outside layers and a zonal-structured cloth layer therebetween to enable elasticity while maintaining structure; a cushioned insole with a three-point support system under the toe crest, the arch, and the heel; and a mixed material insole and outsole to prevent slipping during walking and standing.

20 Claims, 5 Drawing Sheets

(51) Int. Cl.

| | |
|---|---|
| ***A43B 23/02*** | (2006.01) |
| ***A43B 7/1425*** | (2022.01) |
| ***A43B 7/149*** | (2022.01) |

(56) References Cited

U.S. PATENT DOCUMENTS 2,016,522 A * 10/1935 Stein ..... A43B 17/08 36/19.5
2,034,091 A * 3/1936 Dunbar ..... A43B 9/00 36/4
2,101,761 A * 12/1937 Stagl ..... A43B 7/1445 36/145
2,184,082 A * 12/1939 Roberts ..... A43B 23/0255 36/51
2,215,463 A * 9/1940 Di Mauro ..... A43B 13/24 36/75 R
2,755,568 A * 7/1956 Menge ..... A43B 7/1435 36/180
3,082,552 A * 3/1963 Ciaio ..... A43B 23/0255 36/68
4,438,574 A * 3/1984 Johnson ..... A43B 23/0235 36/129
4,813,157 A * 3/1989 Boisvert ..... A43B 7/142 36/145
4,866,860 A * 9/1989 Blissett ..... A43B 7/144 36/28
5,063,692 A * 11/1991 Suginaka ..... A43B 7/142 36/43
6,038,790 A * 3/2000 Pyle ..... A43B 7/1425 36/28
6,098,319 A * 8/2000 Epstein ..... A43B 7/14 36/155
6,176,025 B1 * 1/2001 Patterson ..... A43B 5/001 36/28
6,922,916 B1 * 8/2005 Potter ..... A43B 1/0027 36/1
8,813,391 B1 * 8/2014 Khaitan ..... A43B 7/1425 36/44
10,563,273 B1 * 2/2020 Velu ..... B32B 3/26
2003/0140524 A1 * 7/2003 Robinson, Jr. ..... A43B 7/1425 36/44
2004/0118017 A1 * 6/2004 Dalton ..... A43B 7/142 36/44
2005/0268490 A1 * 12/2005 Foxen ..... A43B 7/145 36/28
2006/0053660 A1 * 3/2006 Lewton ..... A43B 13/36 36/59 R
2006/0288613 A1 * 12/2006 Lo ..... A43B 7/142 36/44
2007/0151124 A1 * 7/2007 Chan ..... A43B 7/145 36/35 R
2007/0199210 A1 * 8/2007 Vattes ..... A43B 7/085 36/45
2007/0294920 A1 * 12/2007 Baychar ..... A43B 3/0084 36/113
2009/0188131 A1 * 7/2009 Doerer ..... A43B 7/1435 36/88
2009/0193683 A1 * 8/2009 Igdari ..... A43B 7/145 36/91
2010/0058540 A1 * 3/2010 Calvert ..... A43B 7/1435 5/652
2010/0170107 A1 * 7/2010 Tzeng ..... A43B 7/144 36/28
2012/0226210 A1 * 9/2012 Normandin ..... A43B 7/142 602/23
2012/0227291 A1 * 9/2012 Rosenbaum ..... A43B 7/1425 36/34 R
2012/0272545 A1 * 11/2012 Chenut ..... A43B 17/02 36/43
2013/0303041 A1 * 11/2013 Kim ..... B32B 27/40 442/1
2013/0318826 A1 * 12/2013 Nathaniel ..... A43B 17/18 36/97
2014/0090273 A1 * 4/2014 Piontkowski ..... A43B 23/17 36/44
2014/0245631 A1 * 9/2014 Joseph ..... A43B 7/141 36/44
2014/0250722 A1 * 9/2014 Lin ..... A43B 17/023 36/44
2014/0317962 A1 * 10/2014 Smith ..... A43B 23/0235 36/102
2015/0196091 A1 * 7/2015 Khaitan ..... A43B 7/1435 36/102
2015/0201702 A1 * 7/2015 Paul ..... A43B 17/14 36/44
2015/0237959 A1 * 8/2015 Wynn ..... A43B 7/145 36/44
2015/0250262 A1 * 9/2015 Khaitan ..... A43B 1/0045 36/44
2015/0257485 A1 * 9/2015 Finkelstein ..... A43B 7/148 36/88
2016/0021972 A1 * 1/2016 Grelle ..... A43B 7/141 36/140
2016/0044990 A1 * 2/2016 Georgeson ..... A43B 17/14 36/43
2016/0206038 A1 * 7/2016 Parke ..... A43B 3/0063
2016/0360825 A1 * 12/2016 Pedersen ..... A43B 13/40
2018/0000196 A1 * 1/2018 Lovell ..... A43B 13/141
2018/0008001 A1 * 1/2018 Jones ..... A43B 7/144
2018/0110291 A1 * 4/2018 Granger ..... A43B 7/144
2018/0168278 A1 * 6/2018 Saint Dunbar ..... A43B 17/14
2018/0168281 A1 * 6/2018 Case ..... A43B 13/12
2018/0192740 A1 * 7/2018 Hsiao ..... A43B 23/0235
2018/0255872 A1 * 9/2018 Manasiya ..... A43B 17/035
2018/0343965 A1 * 12/2018 Mitchell ..... B32B 3/08
2019/0183208 A1 * 6/2019 Dong ..... A43B 17/00

FOREIGN PATENT DOCUMENTS

CN 104382283 A 3/2015
TW 526298 U 8/2016

OTHER PUBLICATIONS

English Translation of CN104382283 A, obtained from https://patents.google.com on Jun. 29, 2021, 7 pages.
English Translation of TWM526298 U, obtained from https://patents.google.com on Jun. 29, 2021, 7 pages.
English Translation of CN102132980 A, obtained from https://patents.google.com on Jun. 29, 2021, 7 pages.
First Office Action for related Chinese Patent Application No. 201811532463.7, dated Jun. 8, 2021, 7 pages.
English Translation (provided by Shanghai Zhi Xin Patent Agent Ltd) of First Office Action for related Chinese Patent Application No. 201811532463.7, dated Jun. 8, 2021, 8 pages.

* cited by examiner

COMFORTABLE DRESS SHOES

TECHNICAL FIELD

The present disclosure relates to dress shoes. More specifically, the present disclosure relates to shoes designed to maintain a structured and elegant look while being adapted for comfort when worn and walked in, even for long periods of time. The features disclosed herein may be used in various types of shoes, including women's high heeled shoes and other types of dress shoes.

BACKGROUND

Shoes may be designed to protect, support and provide comfort to the foot of a wearer while performing various activities. Shoes may also function as a fashion accessory, designed to coordinate with the attire and enhance the physical appearance of the wearer. Fashion may influence certain design elements of shoes, such as high heels or stiff constructions, that negatively impact the comfort of the shoe.

SUMMARY

The present disclosure relates to a shoe designed to enhance comfort and support for the wearer without making the shoe clunky or unattractive. The shoe may remain comfortable to the wearer during long periods of standing and walking, without compromising the look of the shoe.

In an implementation, the comfortable dress shoe may comprise a flexible upper structure having a stretchy leather outside layer, a zonal-structured cloth layer, and a stretchy leather lining layer. In an implementation, the zonal-structured cloth layer may be formed with zonal holes. In an implementation, the dress shoe may comprise a high-heeled dress shoe.

In an implementation, the comfortable dress shoe may comprise an insole having a multi-layer construction. In an implementation, the multi-layer construction may comprise a leather layer; a suede layer; and a cushion layer. In an implementation, the cushion layer may comprise a multi-point support system. In an implementation, the multi-point support system may comprise a toe crest; an arch support; and a heel support. In an implementation, at least one of the toe crest, the arch support and the heel support may comprise an ethylene-vinyl acetate material.

In an implementation, the comfortable dress shoe may comprise a cushioned support structure. In an implementation, the insole may be at least partially disposed on top of the cushioned support structure. In an implementation, the cushioned support structure may be disposed on top of a midsole. In an implementation, the suede layer may comprise breathable holes which allow expansion of the cushioned support structure. In an implementation, the cushion layer may comprise a cutout disposed to receive at least a portion of the cushioned support structure.

In an implementation, the cushioned support structure of the comfortable dress shoe may comprise a cushioned balance structure; and a cushioned circle structure having at least one layer, and positioned on top of the cushioned balance structure. In an implementation, the cushioned balance structure and the cushioned circle structure may provide metatarsal support. In an implementation, the cushioned circle structure may comprise a left circle structure having at least one layer; and a right circle structure having at least one layer.

In an implementation, the comfortable dress shoe may comprise an outsole of mixed material. In an implementation, the outsole may comprise a leather outsole portion; and a rubber outsole portion.

In an implementation, the comfortable dress shoe may comprise a flexible upper structure operable to conform to the wearer's foot while adjusting to variations (expansion and shrinkage) in the size of the foot at different times of day and during different seasons.

In an implementation, the comfortable dress shoe is designed to avoid weight concentration at the front of the foot. The shoe may adjust weight to be evenly distributed in the front, middle, and back of the foot.

In an implementation, the comfortable dress shoe is designed to add stability by increasing grip on the outside and the inside of the shoe.

In an implementation, the comfortable dress shoe may comprise a zonal-structured cloth inserted between the flexible upper and a lining. In an implementation, this shoe structure may provide structural support to maintain the shape and structure of the shoe while allowing stretch to conform to the wearer's foot.

In an implementation, the comfortable dress shoe may comprise an insole with a cushion layer having a three-point support system comprising supports positioned in the toe crest area, the arch area, and the outer ring of the heel cap. In an implementation, this three-point support system achieves one or more of the following: reduction of shock in the front of the foot, even distribution of weight throughout the shoe, and maintaining the foot in the proper position within the shoe instead of slipping forward.

In an implementation for a high-heeled shoe (a shoe having a heel which is approximately 9.5 cm or greater), the comfortable dress shoe may comprise a five-point support system comprising supports positioned in: 1) the toe crest area (for the big toe, second toe, and third toe); 2) the first and second metatarsal area; 3) the third and fourth metatarsal area; 4) the arch of the foot; and 5) the outer ring of the heel cap. In an implementation, this five-point support system achieves one or more of the following: reduction of shock in the front of the foot, even distribution of weight throughout the shoe, and maintaining the foot in the proper position within the shoe instead of slipping forward.

In an implementation, the comfortable dress shoe may comprise a combination of leather and suede in the insole of the shoe. In an implementation, this combination increases grip between the foot bed and the insole.

In an implementation, the comfortable dress shoe may comprise rubber added to the outsole of the shoe to cover the tip and the ball of the foot. In an implementation, this rubber increases grip between the shoe and a walking surface.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Dress shoes are typically constructed with more emphasis on fashion than on functionality. Dress shoes are often formed with leather uppers that have a structured and smooth finish, making them inherently less comfortable than sandals or sneakers. Moreover, women's high-heeled shoes present additional challenges with fit and weight distribution. Since the upper only covers part of the foot and there are no shoe laces to help correct sizing discrepancies, women's high-heeled shoes are more likely to be ill-fitted to the wearer's foot than other types of dress shoes, causing rubbing and blisters during walking. Additionally, since the foot is angled in a high-heeled shoe, 80-90% of the body weight is put on the ball (metatarsals) and toes of the foot, while the heel of the foot functions to help maintain balance during walking, causing pain in those areas.

Methods for enhancing the comfort level of high-heeled shoes have been attempted, such as inserts. However, inserts do not fit all shoe types and often end up over-crowding the already-limited space in a high heeled shoe. There have also been different cushioning systems attempted, often by replacing the rigid part of the midsole or insole with softer cushioning. This approach, while providing instant softness to the bottom of the foot, fails to ergonomically correct weight distribution. For example, arch cushioning may be added to the insole of the shoe, but since the arch does not bear much of the body weight, the problem of metatarsal pain persists. In addition, soft material in the insole or midsole also further compromises the supporting structure of the shoe. As a result, the wearer experiences fatigue in the feet after long periods of walking or standing.

Figure 1:
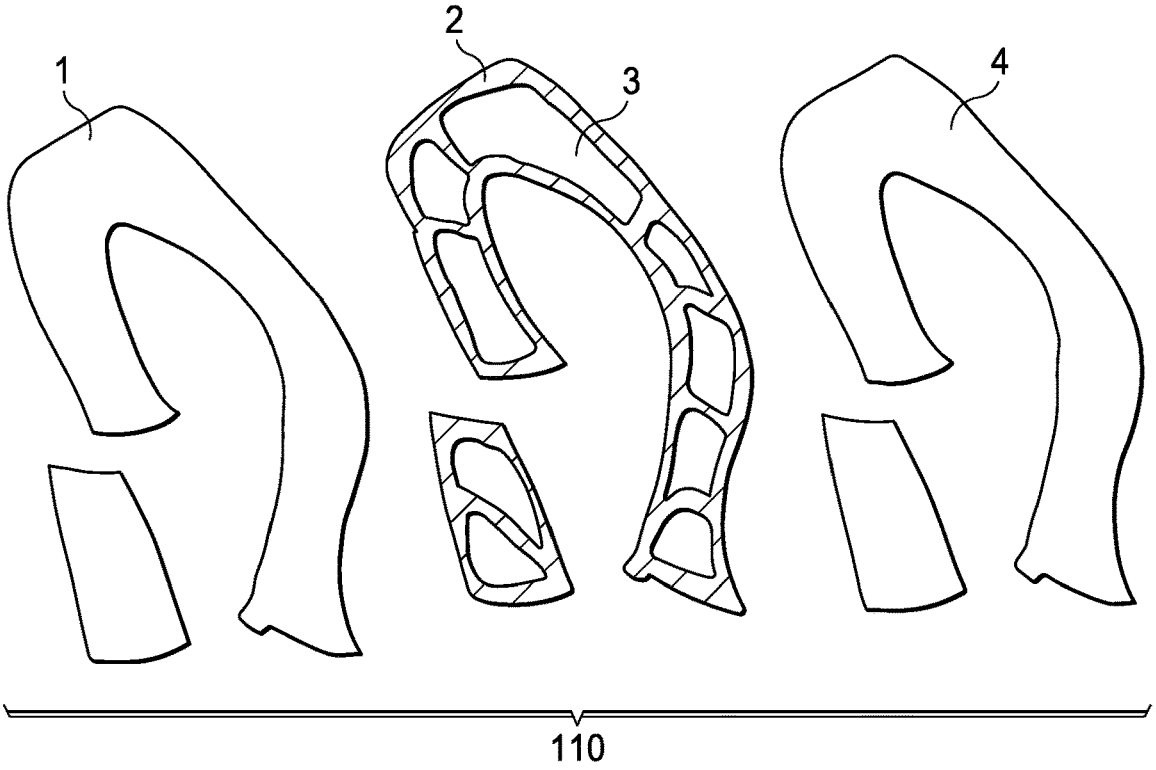
FIG. 1 illustrates three-layers of an upper structure of a shoe, according to the present disclosure.

FIGS. 1-9 depict various views of components of a comfortable dress shoe 100 according to an implementation of the present disclosure. FIG. 1 depicts an exploded view of an implementation of a three-layer upper 110 of shoe 100 according to the present disclosure. As depicted, the upper 110 of shoe 100 is constructed of a lining layer 1, a zonal-structured cloth layer 2 formed with zonal holes 3, and an outside layer 4. The lining 1 may comprise a stretchy suede leather, the zonal-structured cloth 2 may comprise cotton cloth with adhesive on both sides, and the outside layer 4 may comprise stretchy leather or suede leather.

In an implementation, both the lining 1 and the outside layer 4 are formed of leather with a stretchy fabric, such as Leather with Lycra®. Traditional soft leather, such as lambskin leather, may be layered with Lycra® fabric (97% cotton, 3% Lycra®—with a stretch percentage of roughly 30%) to add flexibility and elasticity while maintaining the look and feel of leather.

Figure 2:
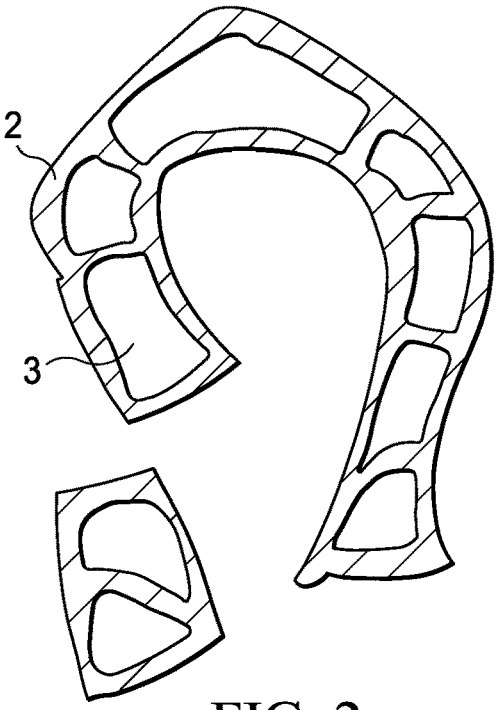
FIG. 2 illustrates the zonal-structured cloth layer of the three-layered upper structure shown FIG. 1, according to the present disclosure.

FIG. 2 depicts the zonal-structured cloth layer 2 with zonal holes 3 that forms the middle layer of the upper 110 that is positioned between the lining 1 and the outside layer 4. In an implementation, the zonal-structured cloth layer 2 comprises an adhesive cotton cloth (stretch percentage roughly 5-10%) with zonal holes 3 that are filled with adhesive. With this construction, the two layers of stretchy leather, the inside lining 1 and outside layer 4, can stretch and adapt according to the wearer's foot. The zonal holes 3 allow the attached materials of the lining 1 and the outside layer 4 to stretch while the adhesive cotton 2 provides structure and support that maintains the shape of the shoe 100. Thus, the zonal-structured cloth layer 2 provides additional support and allows the shoe to maintain structure without compromising the stretchiness of the Lycra® fabric. As a result of the flexibility and elasticity of the upper 110, the shoe 100 is operable to conform to the user's foot while adjusting to variations in the size of the foot (expansion and shrinkage) at different times of the day and at different environmental temperatures during different seasons.

To ensure the zonal-structured cloth layer 2 does not show on the outer layer 4 and compromise the smooth look of the upper 110, the thickness of the outer layer 4 may be greater, in the range of 1 to 1.1 millimeters, for example, as compared to the thickness of the zonal-structured cloth layer 2, in the range of 0.3 millimeters, for example.

Figure 4:
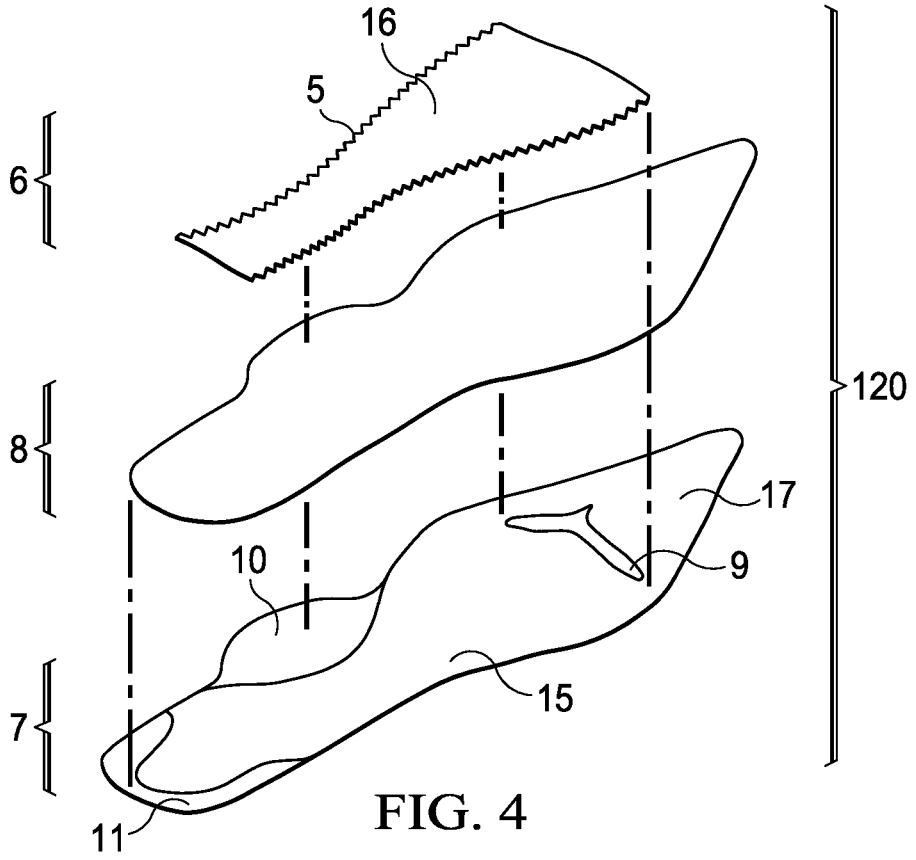
FIG. 4 illustrates an exploded view of an insole construction of a shoe, according to the present disclosure.

FIG. 4 depicts an exploded view of an implementation of a three-layer insole 120 of shoe 100 according to the present disclosure. As depicted, the insole 120 of shoe 100 is constructed of a leather layer 6, a suede layer 8, and a cushion layer 7.

Figure 5:
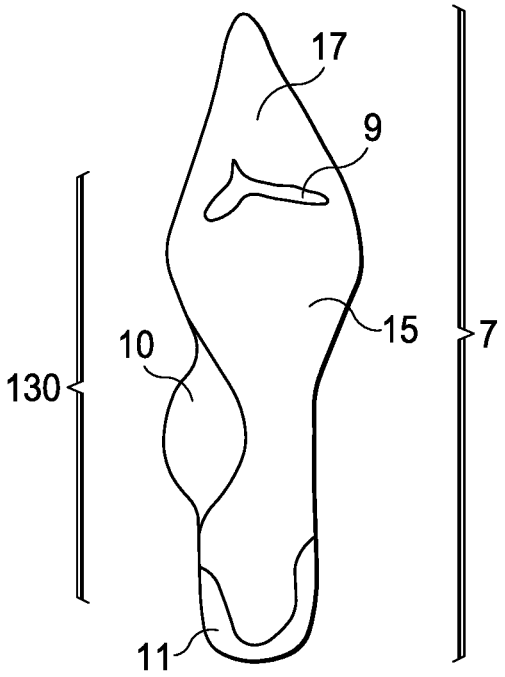
FIG. 5 illustrates a plan view of the cushion layer having a three-point support structure of FIG. 4, according to the present disclosure.

FIG. 5 illustrates the cushion layer 7 of the insole 120 of shoe 100. In an implementation, the cushion layer 7 comprises a three-point support system 130: the toe crest 9 disposed between where the toes end and where the metatarsals start, the arch support 10, and the U-shaped heel support 11. One or more of the toe crest 9, the arch support 10 and heel support 11 may be formed of EVA (ethylene-vinyl acetate) material. The shape and thickness of each component of the three-point support system 130 may be ergonomically designed: the toe crest 9 may be thicker in the middle and skived around the edge, creating a natural slope for the toe crest to be supported while the toes and ball of the foot can rest naturally; the arch support 10 may be highest on the outside arch (around 2 cm) and gradually sloped down towards the middle; and the U-shaped heel support 11 may be highest towards the back of the heel (around 1 cm) and sloped down towards the inner heel, creating a natural cup for the heel to rest into and stabilize during walking. This three-point support system avoids weight concentration at the front of the foot, allowing weight to be evenly distributed in the front, middle, and back of a user's foot.

Still referring to FIG. 5, an EVA sock 15 may also be provided where the toe crest 9, the arch support 10 and heel support 11 are glued. In an implementation, the EVA sock 15 has a thickness of about 2 millimeters. In an embodiment, the EVA sock 15 may comprise a frontal piece 17 skived to a range of about 1 millimeter to 1.5 millimeters to create more room in the toe box area, without having to expand the pattern of the upper 110, which would compromise the look of the shoe 100.

Figure 3:
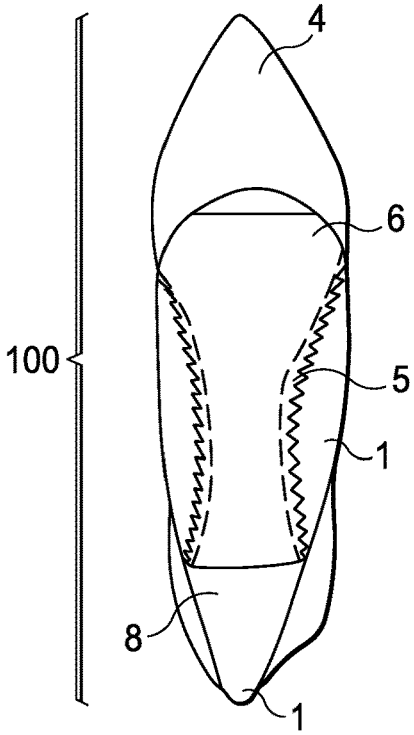
FIG. 3 illustrates a top plan view of the shoe of FIG. 1, depicting different materials comprising the outside upper, inside lining, and insole, according to the present disclosure.
Figure 6:
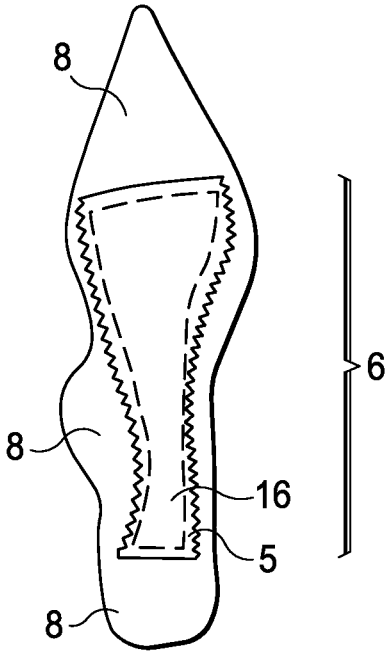
FIG. 6 illustrates a plan view of the assembled insole construction of FIG. 4, according to the present disclosure.

FIG. 6 illustrates the visible portion of the insole 120 comprising the leather layer 6 and the suede layer 8. These two layers 6, 8 can be seen from a top-down view of the shoe 100, as shown in FIG. 3. The leather layer 6 may comprise a slightly stiffer leather, such as goat skin. In some implementations, the thickness of an edge 5 of the leather layer 6 may be less than the thickness of a center area 16 of the leather layer 6. In an implementation, the thickness of the edge 5 may be about half of the thickness of the center area 16. In an implementation, the edge 5 may be about 0.3 millimeters thick, while the center area 16 may be about 0.6 millimeters thick. The leather layer edge 5 may be skived in order to create a smoother transition from the leather layer 6 to the suede layer 8, while providing grip between the bottom of the foot and the insole.

Figure 7:
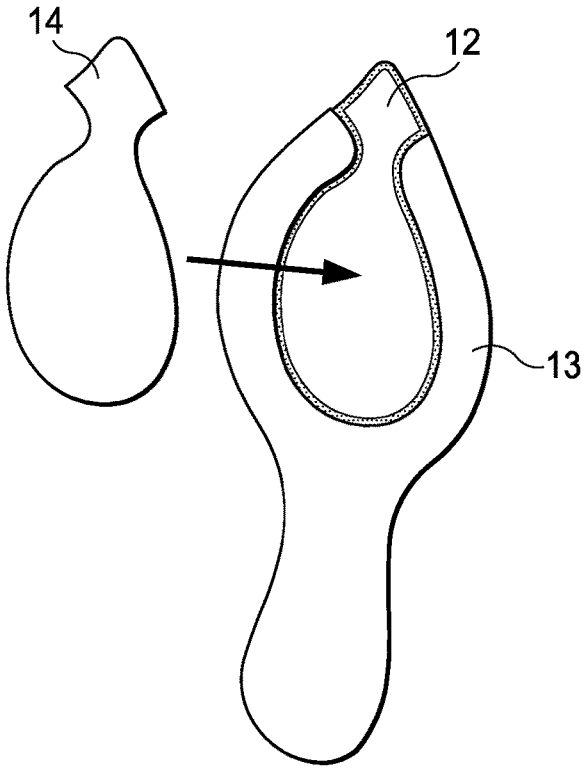
FIG. 7 illustrates an outsole construction of a shoe, according to the present disclosure.
Figure 8:
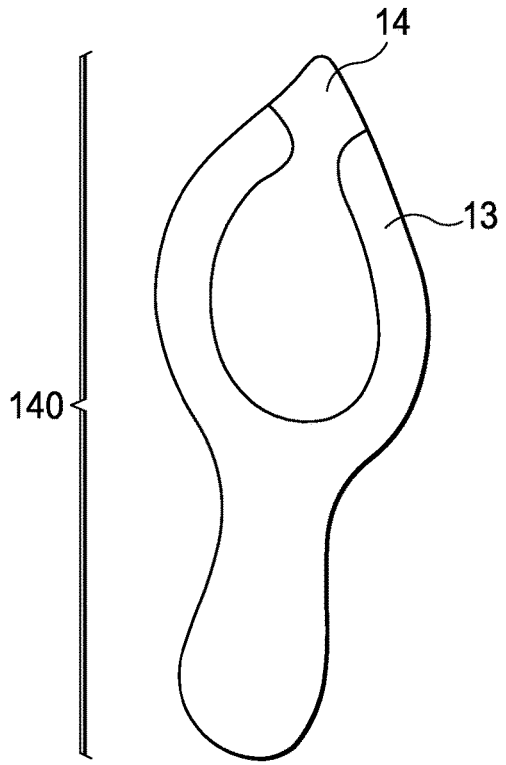
FIG. 8 illustrates an implementation of an assembled outsole construction of a shoe, according to the present disclosure.
Figure 9:
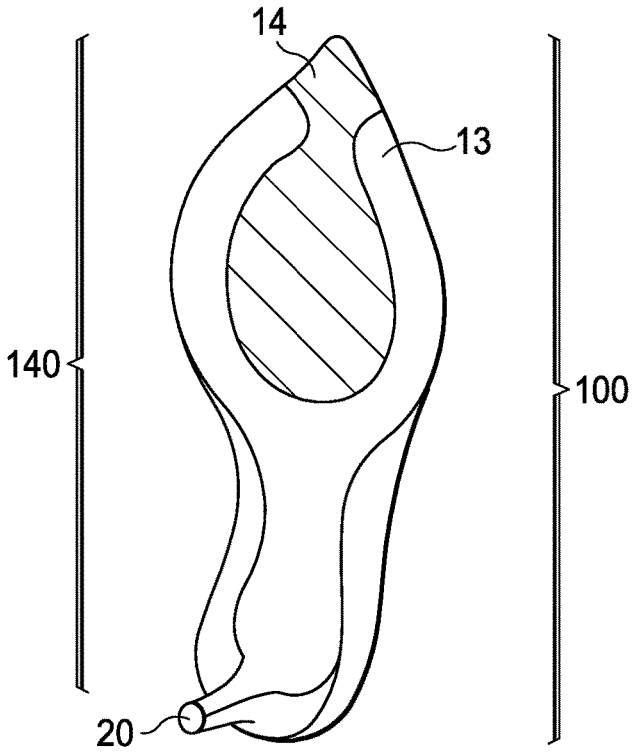
FIG. 9 illustrates a bottom-up perspective view of an implementation of a shoe that includes the outsole construction of FIG. 8 attached to the shoe, according to the present disclosure.

FIGS. 7-9 depict various views of an implementation of an outsole 140 of the shoe 100 according to the present disclosure. The outsole 140 comprises a leather outsole portion 13 and a rubber outsole portion 14. As best shown in FIG. 7, a shape to receive rubber outsole portion 14 may be carved out of leather outsole portion 13 to create a fitting slot 12 that approximately matches the thickness of rubber outsole portion 14. In an implementation, the fitting slot 12 is approximately 1 millimeter deep. Rubber outsole portion 14 is then glued into fitting slot 12.

FIG. 8 illustrates the finished look of the combined outsole 140, and FIG. 9 illustrates the finished look of the bottom of shoe 100. Rubber outsole portion 14 may be designed to align with the ball of the foot and the tip of shoe 100. Leather outsole portion 13 may be skived to be thinner on the edge than in the center, creating a slope, so that the leather outsole portion 13 does not touch the ground. Referring to FIG. 9, in such a construction with a skived leather outsole portion 13, when a wearer is walking in shoe 100, rubber outsole portion 14 and rubber heel cap 20 may be the only components touching the ground, thereby increasing the grip between shoe 100 and a walking surface and providing an anti-slip feature.

Figure 10:
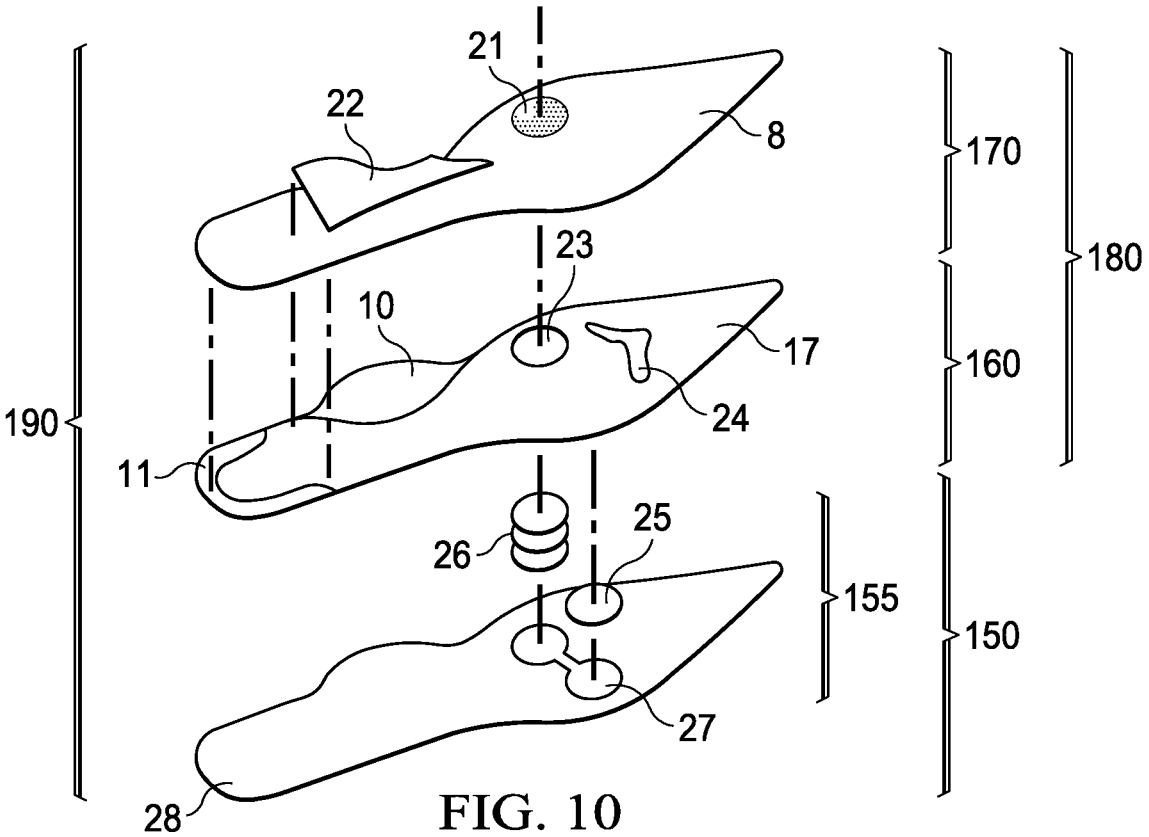
FIG. 10 illustrates an implementation of an internal construction of a high-heeled shoe, according to the present disclosure.

FIGS. 10-13 illustrate an alternate implementation of the internal structure for a high-heeled shoe (having a heel size of 95 mm or greater). FIG. 10 depicts an exploded view of the internal structure 190 of a shoe having a higher heel (95 mm or greater). As depicted, the internal structure 190 comprises a first layer 170, a second layer 160, and a third layer 150. The first and second layers 170, 160 together comprise the insole 180. The first layer 170 of insole 180 comprises a leather layer 22 and a suede layer 8. The second layer 160 of insole 180 comprises cushion layer 17 having a toe crest 24, an arch support 10, and a U-shaped heel support 11. The third layer 150 comprises a midsole layer 28 and a cushion support structure 155. The cushion support structure 155 further comprises a cushioned one-layer circle structure 25, a cushioned three-layer circle structure 26, and a cushioned one-layer balance structure 27.

Figure 11:
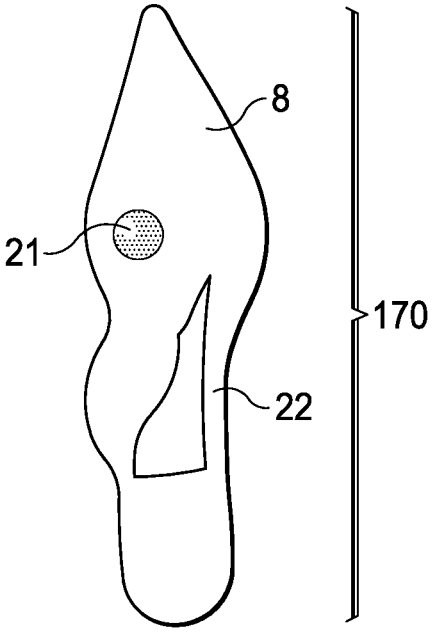
FIG. 11 illustrates a plan view of the first layer of the internal construction of FIG. 10, according to the present disclosure.

Reference is now made to FIG. 11, wherein is shown the first layer 170 of insole 180. The first layer 170 comprises the leather layer 22, the suede layer 8, and breathable holes 21 disposed on suede layer 8. The leather layer 22 may comprise a slightly stiffer leather, such as goat skin. The edge of leather layer 22 may be skived in order to create a smoother transition from the leather layer to the suede layer 8, while providing enough grip between the bottom of the foot and the insole. The breathable holes 21 are positioned on suede layer 8 to align with cushioned three-layer circle structure 26 to support the first and second metatarsals of a user's foot. When a user applies pressure on the insole 180, the breathable holes 21 allow greater expansion of the cushioned three-layer structure 26 disposed thereunder.

Figure 12:
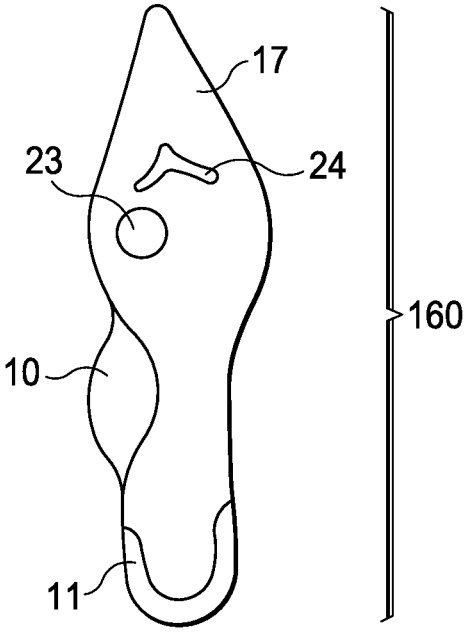
FIG. 12 illustrates a plan view of the second layer of the internal construction of FIG. 10, according to the present disclosure.

Reference is now made to FIG. 12, wherein is illustrated the second layer 160 of the insole 180. In an implementation, the second layer 160 comprises cushion layer 17 having an adjusted three-point support system: the adjusted toe crest 24 disposed between where the toes end and where the metatarsals start (but is laterally shortened from the implementation shown in FIG. 5 to only cover the area from the first to the third toes), the arch support 10, and the U-shaped heel support 11. One or more of the toe crest 24, the arch support 10 and heel support 11 may be formed of EVA (ethylene-vinyl acetate) material. The shape and thickness of each component of the three-point support system comprising the second layer 160 may be ergonomically designed. The toe crest 24 may be thicker in the middle and skived around the edge, creating a natural slope for the toe crest to be supported while the toes and ball of the foot can rest naturally; the arch support 10 may be highest on the outside arch (around 2 cm) and gradually sloped down towards the middle; and the U-shaped heel support 11 may be highest towards the back of the heel (around 1 cm) and sloped down towards the inner heel, creating a natural cup for the heel to rest into and stabilize during walking. The carved hole 23 is substantially the same size and shape as the cushioned three-layer circle structure 26 of third layer 150 and is disposed to receive cushioned three-layer circle structure 26 therethrough. The carved hole 23 allows greater expansion of the cushioned three-layer circle structure 26, and promotes balance of the cushion support structure 155 that is positioned on the midsole.

Figure 13:
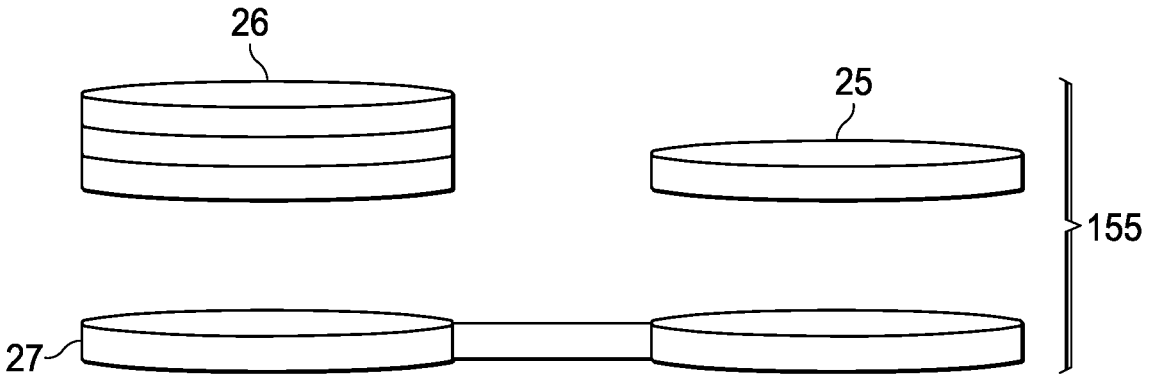
FIG. 13 illustrates the cushioned support structure of FIG. 10, according to the present disclosure.

FIG. 13 illustrates the cushion support structure 155 of third layer 150. Cushion support structure 155 is designed to specifically support the ball of the foot. In high-heeled constructions, this is precisely where a user would apply excessive pressure. The extra cushion provided by the cushioned support structure 155 alleviates such pressure. The cushion support structure 155 comprises a three-layer circle structure 26, a one-layer circle structure 25, and a one-layer balance structure 27. The one-layer balance structure 27, having two circular cushion structures with a "bridge" connector, sits atop midsole layer 28 and serves as a stabilizer. The left circular cushion of the one-layer balance structure 27 supports and stabilizes the first and second metatarsals of a user's foot. The right circular structure of the one-layer balance structure 27 supports and stabilizes the third and fourth metatarsals of a user's foot. The three-layer circle structure 26 is positioned on top of the left circular structure of the one-layer balance structure 27, and fits through cutout 23 of cushion layer 17. The one-layer circle structure 25 sits atop the right circular structure of the one-layer balance structure 27 and sits underneath cushion layer 17. One or more of the three-layer circle structure 26, one-layer circle structure 25, and one-layer balance structure 27 may be formed of EVA (ethylene-vinyl acetate) material. Each layer has a thickness of approximately 2 mm. The cushion support structure 155, together with the three-point support system of the cushion layer 17 helps reduce shock in the front of the foot, allows for even distribution of weight throughout the shoe, and maintains the foot in proper position within the shoe by preventing forward slipping of the foot within the shoe. It is to be understood that while cushion support structure 155 is described herein as comprising a three-layer circle structure 26, a one-layer circle structure 25, and a one-layer balance structure 27, these component structures of cushion support structure 155 are not intended to be so limited and may comprise any number of layers to provide balance and support to the user.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A comfortable dress shoe comprising:

a flexible upper structure having a stretchy leather outside layer, a zonal-structured cloth layer, and a stretchy leather lining layer;

wherein each of the stretchy leather outside layer and the stretchy leather lining layer are formed of a natural leather layered with a stretchy fabric having a stretch percentage of approximately 30%.

2. The comfortable dress shoe of claim 1, wherein the zonal-structured cloth layer is formed with zonal holes.

3. The comfortable dress shoe of claim 2, wherein:

the zonal-structured cloth layer comprises an adhesive cotton cloth; and at least some of the zonal holes are filled with adhesive.

4. The comfortable dress shoe of claim 1, wherein the dress shoe comprises a high-heeled dress shoe.

5. The comfortable dress shoe of claim 1, further comprising:

an insole having a multi-layer construction.

6. The comfortable dress shoe of claim 5, wherein the multi-layer construction comprises:

a leather layer;

a suede layer; and a cushion layer.

7. The comfortable dress shoe of claim 6, wherein the cushion layer comprises:

a multi-point support system.

8. The comfortable dress shoe of claim 7, wherein the multi-point support system comprises:

a toe crest;

an arch support; and a heel support.

9. The comfortable dress shoe of claim 8, wherein at least one of the toe crest, the arch support and the heel support comprises an ethylene-vinyl acetate material.

10. The comfortable dress shoe of claim 6, further comprising:

a cushioned support structure.

11. The comfortable dress shoe of claim 10, wherein the insole is at least partially disposed on top of the cushioned support structure.

12. The comfortable dress shoe of claim 11, wherein the cushioned support structure is disposed on top of a midsole.

13. The comfortable dress shoe of claim 10, wherein the suede layer comprises:

breathable holes aligned with a portion of the cushioned support structure positioned below the suede layer.

14. The comfortable dress shoe of claim 10, wherein the cushion layer comprises:

a cutout disposed to receive at least a portion of the cushioned support structure.

15. The comfortable dress shoe of claim 10, wherein the cushioned support structure comprises:

a cushioned balance structure; and a cushioned circle structure having at least one layer, and positioned on top of the cushioned balance structure.

16. The comfortable dress shoe of claim 15, wherein the cushioned balance structure and the cushioned circle structure provide metatarsal support.

17. The comfortable dress shoe of claim 15, wherein the cushioned circle structure comprises:

a left circle structure having at least one layer; and a right circle structure having at least one layer.

18. The comfortable dress shoe of claim 1, further comprising:

an outsole of mixed material.

19. The comfortable dress shoe of claim 18, wherein the outsole comprises:

a leather outsole portion; and a rubber outsole portion.

20. The comfortable dress shoe of claim 1, wherein:

the stretchy leather outside layer has a greater thickness than the zonal-structured cloth layer.

* * * * *